US008986166B2

(12) United States Patent
Nishimura

(10) Patent No.: US 8,986,166 B2
(45) Date of Patent: Mar. 24, 2015

(54) ELECTROMECHANICAL SYSTEM FOR SELECTING WEIGHTS IN FITNESS STATION WEIGHTS TOWERS

(76) Inventor: Takashi Nishimura, São Paulo (BR)

( * ) Notice: Subject to any disclaimer, the term of this patent is extended or adjusted under 35 U.S.C. 154(b) by 567 days.

(21) Appl. No.: 13/321,510

(22) PCT Filed: May 17, 2010

(86) PCT No.: PCT/BR2010/000159

§ 371 (c)(1),
(2), (4) Date: Jan. 9, 2012

(87) PCT Pub. No.: WO2010/132967

PCT Pub. Date: Nov. 25, 2010

(65) Prior Publication Data

US 2012/0100961 A1 Apr. 26, 2012

(30) Foreign Application Priority Data

May 20, 2009 (BR) ..... 10901645

(51) Int. Cl.
*A63B 24/00* (2006.01)
*A63B 21/00* (2006.01)
*A63B 21/062* (2006.01)

(52) U.S. Cl.
CPC ..... *A63B 21/062* (2013.01); *A63B 24/00* (2013.01); *A63B 2021/0623* (2013.01)
USPC ..... 482/5; 482/93

(58) Field of Classification Search
CPC .... A63B 21/00; A63B 21/06; A63B 21/0601; A63B 21/0609; A63B 21/062; A63B 21/078; A63B 21/154
USPC ..... 482/93–99
See application file for complete search history.

(56) References Cited

U.S. PATENT DOCUMENTS

2002/0025888 A1* 2/2002 Germanton et al. ..... 482/1

FOREIGN PATENT DOCUMENTS

BR PI0501372 A 11/2006
BR PI0602697 A 1/2008
BR PI0603626 A 4/2008

OTHER PUBLICATIONS

PCT/BR2010/0001159, International Search Report, mailed Jul. 7, 2010.

* cited by examiner

*Primary Examiner* — Justine Yu
*Assistant Examiner* — Rae Fischer
(74) *Attorney, Agent, or Firm* — Arent Fox LLP

(57) ABSTRACT

An electromechanical system for selecting weights in fitness station weight towers, wherein a vertical hollow rod, fixed to the cursor which fastens to the steel cable, which lifts the plates of unit weight, extends traversing central holes of these plates, traversing the upper wall of the base of the tower, which is hollow, this rod having a rotating shaft or screw that moves the weight selector upwards and downwards, mounted on the rod by bearings, and projecting below this bearing where it has at the end radial teeth that incase between protrusions existing in a circular low relief of a pulley, which is mounted on a bearing whose shaft is collinear to the rod and fixed to the lower face of the base, this pulley having a channel for a belt, driven by an electric motor fixed to the base.

7 Claims, 4 Drawing Sheets

ELECTROMECHANICAL SYSTEM FOR SELECTING WEIGHTS IN FITNESS STATION WEIGHTS TOWERS

CROSS-REFERENCE TO RELATED APPLICATIONS

This application is the National Stage entry of international application No. PCT/BR2010/000159, filed May 17, 2010, and claims the priority of Brazil Application No. PI 0901645-7, filed May 20, 2009, the entire specifications, claims and drawings of which are incorporated herein by reference.

BACKGROUND

1. Field

The present specification refers to an electromechanical system for selecting weights in a fitness station weight tower and, more specifically, an electromechanical system which coupled to a fitness station weights tower acts in conjunction with a combination of fractional weights to harness to the traction cable of the fitness station the total value of the weight selected by the user.

2. Introduction

As those skilled in the art are aware, fitness station weight towers have various unit weights stacked, which may, in whole or in part, be lifted inside the towers by central vertical steel cables, tractioned by active members of the fitness station driven by the user. Selecting the weights to lift can be obtained by inserting a horizontal pin which traverses a hole existing in each weight in correspondence with a sequence of holes of a tenon that extends below the lower weight and fastens superiorly to the steel cable. A weight selected by the pin carries with it all the weights above it.

The most modern towers have electromechanical systems for selecting weights, commanded by a panel fixed to the fitness station.

Generally, fitness stations present a proximate tower, which by way of steel cables, linked to levers, pulleys and cams of the respective station, promotes the mechanical interlink between the contact accessory, bars, hand control and other devices, offered to the user for a certain exercise and the grouping of weights selected, which are mounted on the tower.

This grouping of weights is comprised by the stacking of unit mass plates, lifted inside the tower by means of a steel cable, coming from the fitness station, which is fastened at the center, on a cursor guided by internal columns. A central vertical rod of the cursor traverses all the weights below the cursor, in vertically-aligned holes, and this rod has, at the level of each weight plate, holes or grooves so that the pin, driven by the user, traverses holes or grooves of each weight plate, engaging one of them to the vertical rod. Accordingly it is possible to select as many weight plates as it is desirable to lift, as the plate engaged to the vertical rod lifts all those above it.

As those skilled in the art are aware as are those who practice this type of physical activity, physical fitness exercises obey a weight alteration sequence, comprised by a specific program indicated by the trainer. The user or participant, therefore, resorts countless times to change of position of the selection pin in the stack of weights.

However, the tower housing the grouping of weights cannot always be near the user due to the range of movements of the arms, levers, and so frequent changes of weight may become inconvenient.

In this sense, means thus arose for selecting weights with the assistance of electric motors or solenoids, commanded by a panel in a position that is easy to reach by the user. Among the various means created, some move pins in and out of the weights to engage them with the central vertical rod, which raises the weight chosen plus those above it. The cursor, which is a guide for vertical movement, and which operates with the rod and the steel cable, is used to accommodate the system for selecting weights, by means of an electric motor or solenoids.

Regardless of the kind of drive and selection of the weights, it is also known that the descent of these weights to the lower stopper of the tower, or on the weights that were not selected to be lifted, may cause a mechanical shock, if the user quickly releases their handling. Another way in which this not always smooth descent may occur is potentially when there a rupture of the steel cable, causing a free fall movement of the selected plates, which violently crash down on the inoperative plates resting on the base of the tower, or crash directly onto the latter. With these inadvertent and/or accidental shocks, solenoids and motors, as well as sensors and other electromechanical devices become susceptible to damage with the occurrence of repetitive shocks.

It is, therefore, one of the objectives of the present invention to provide an electromechanical system for selecting weights in fitness station weights towers that seeks to solve the problem of defects due to mechanical shocks, in which electromechanical mechanisms and other electric devices are incorporated to the cursor and to the stack of weights.

Another objective of the present invention is to provide an electromechanical system for selecting weights in fitness station weights towers which being electromechanical do not have the electrical wiring that accesses the motor, or solenoids or associated electrical devices, and which communicates to the tower with the station command panel, hanging on a part in movement.

SUMMARY

These and other objectives and advantages of the present invention are achieved by an electromechanical system for selecting weights in fitness station weights towers brought into effect by a tower, formed by vertical columns, upper crosspiece, lower base, with a stack of unit weight plates, with vertical guides inside the tower, fixed to the upper crosspiece and to the base, with the stack of plates headed by a cursor which in the center fastens to the steel cable that lifts the weights, this cursor having a central rod projected downwards, penetrating into central holes of all the plates and provided with means of selective engagement to any plate, represented by a vertical screw, disposed in the hollow center of the rod and mounted thereon by bearings situated at the upper and lower parts of the rod. According to the present invention the base of the tower is hollow, and has installed on its inside an electromechanical mechanism for selecting weights, comprised by an electric motor, at least a belt, and at least a pulley, mounted by bearing to a shaft fixed to the lower face of the base, collinearly to the center of the rod and screw, this pulley having, in the upper part, a selective engagement mechanism with the lower end of the screw to actuate only when the rod is totally lowered, with the plates resting on the base of the tower.

An electromechanical system for selecting weights in fitness station weight towers, wherein a vertical hollow rod, fixed to the cursor which fastens to the steel cable, which lifts the plates of unit weight, extends traversing central holes of these plates, traversing the upper wall of the base of the tower, which is hollow, this rod having a rotating shaft or screw that moves the weight selector upwards and downwards, mounted on the rod by bearings, and projecting below this bearing where it has at the end radial teeth that encase between protrusions existing in a circular low relief of a pulley, which is mounted on a bearing whose shaft is collinear to the rod and fixed to the lower face of the base, this pulley having a channel for a belt, driven by an electric motor fixed to the base; a rod upon traversing the upper wall of the base has a circular low relief in which there is encased a latch propelled against the low relief by a spring and which may be disengaged by a trigger that can be pulled by an electromechanical linear actuator, with a sensor indicating the position of the latch; the pulley has a disk with recesses to drive a sensor fixed to the base by a support.

It is understood that other aspects of the invention will become readily apparent to those skilled in the art from the following detailed description, wherein various aspects of the present invention are shown and described by way of illustration only. As will be understood, the present invention is capable of other and different variations and its several details are capable of modification in various other respects, all without departing from the scope of the invention. Accordingly, the drawings and detailed description are to be regarded as illustrative in nature and not as restrictive.

BRIEF DESCRIPTION OF THE DRAWINGS

The accompanying drawings, which are incorporated in and constitute a part of this specification, illustrate various example implementations consistent with aspects of the invention, and, together with the description, serve to explain the principles thereof.

DETAILED DESCRIPTION

Figure 1:
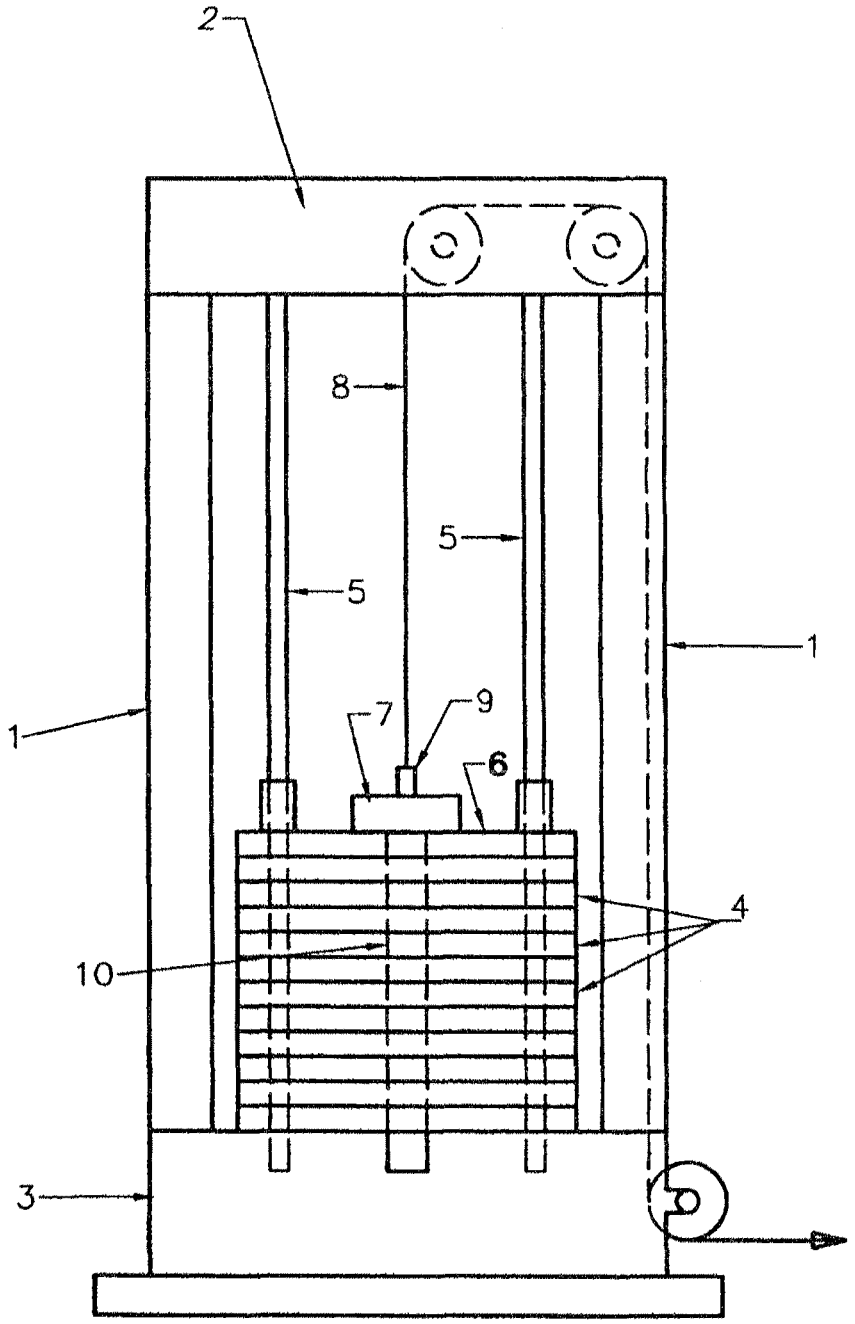
FIG. 1 depicts a raised front view of a weights tower, in accordance with some aspects of the present invention.
Figure 2:
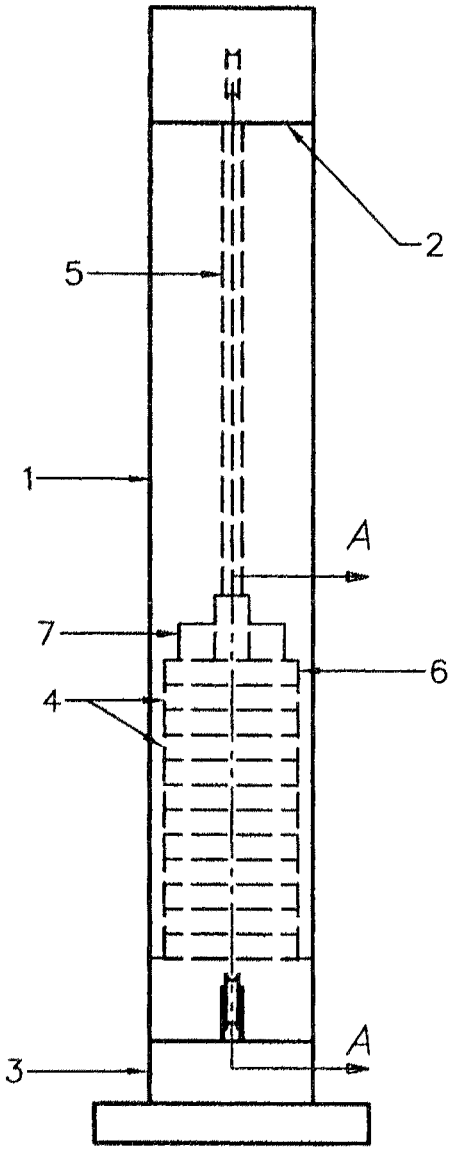
FIG. 2 is a raised side view of the weights tower, in accordance with some aspects of the present invention.

As shown in the figures, an electromechanical system for selecting weights in fitness station weights towers may include a weights tower (see FIGS. 1 and 2) that consists of a structure formed by vertical columns 1, upper crosspiece 2 and lower base 3. The system may include a stack of weights formed by unit weight plates 4 on top of each other, and guided in vertical movement by guides 5. The guides 5 are tubes or vertical bars fastened to the crosspiece 2 and to the base 3. A cursor 6, which is a board, is disposed on the stack of plates 4, with tubes wherein guides 5 are encased. The system further includes a central support 7 where the steel cable 8 of the tower is fastened by a screw or nipple 9.

Figure 3:
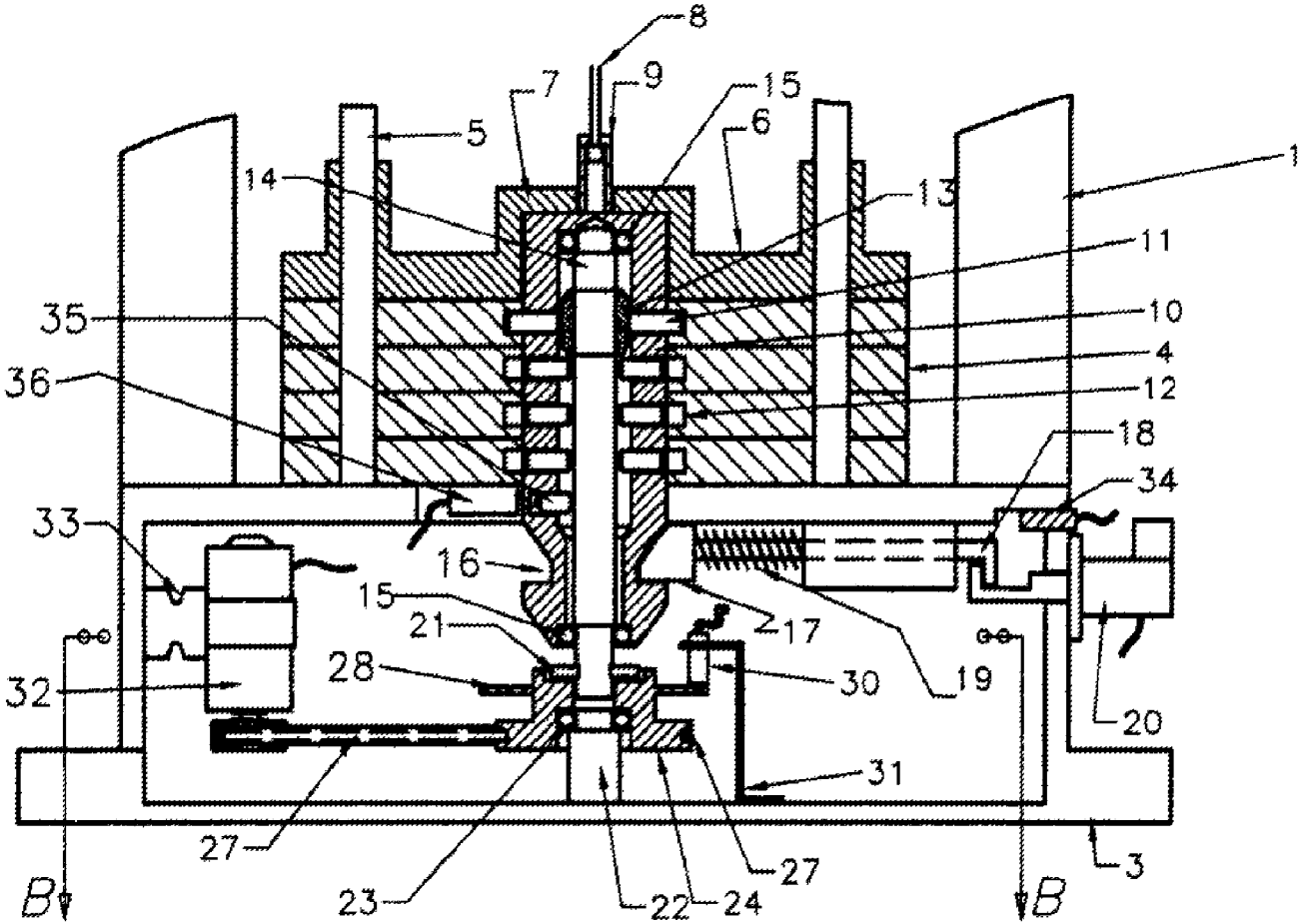
FIG. 3 is a vertical cut view of the lower part of the tower, passing through the center of the stack of weights, containing a lesser quantity of weight plates to facilitate understanding, and for the purpose of illustration without any limitative character, only a set of four weight plates is being presented, in accordance with some aspects of the present invention.

The cursor 6 centrally has a vertical rod 10 that traverses central holes of all the plates 4, and the device for selecting weights is incorporated into the rod 10, as shown in FIG. 3.

According to the present invention, selective engagement, illustrated in FIG. 3, is performed by the expansion of one or more pairs of pins 11, mounted in radial holes of the rod 10, at the level of the center of each plate 4, on which there are radial holes 12 that can receive the encasement of the pins 11 which were displaced partially outside the rod 10, at the level selected for the engagement.

The expansion of the pins 11 at a certain level is carried out by a nut 13 with conic ends, mounted on a vertical screw 14, and disposed in the center of a central axial hole of the rod 10. The screw 14 may be mounted to the rod by bushings or bearings 15. Turning the screw 14 causes the nut 13 to go up or down, to alter the quantity of plates 4 to be raised. Conic ends of the nut 13 outwardly push the pins 11. Before being pushed outwardly by the nut 13, the pints 11 do not extend into the holes 12 of the plates 4. After being pushed outwardly by the nut 13, the pins are encased in holes 12 and remain encased in the radial holes of the rod 10. Therefore, the selected plate 4 becomes secured to the rod 10 and can be lifted by the steel cable 8, carrying with it the plates 4 that are above them. The remaining plates below the selected plate rest on the base 3 of the tower.

Generally, to move the screw 14 inside the rod, or another selected plate engagement device 4, an electric motor or solenoids are used, installed in the cursor 6 which has a rod 10, normally mounted on the central support 7 of this cursor, and the electromechanical drive combination accompanies the rising or lowering of the weights, with its electric communication to the command panel by way of a flexible electric cable hung and attached to the connector at the top of the tower in order to avoid rupture by stretching.

This construction subjects the electromechanical devices to shocks, when the weights are lowered with speed by the user of the fitness station, and it is knowingly very difficult to construct these devices with resistance to repetitive mechanical shocks and to fatigue. In contrast, if there is a rupture of the steel cable while the weights are suspended, the shock due to free fall, with hardly any damping, may mean the loss of the electromechanical devices. Another undesirable condition consists of involuntary driving of the weight selector while they are suspended, causing release of plates in free fall on the inside of the tower, which may occur due to deficiency in the electro-electronic command system of the panel.

The present invention presents a solution for the problems cited above, and introduces total security in handling the weights by electromechanical means.

As can be seen in FIG. 3, the base 3 of the tower is hollow, and installed therein is the mechanism for selecting weights. This base has in the upper part a hole that is traversed by the lower part of the rod 10, where it has a circumferential recess 16, in which there is encased a latch 17 similar to that of a door lock, with a spring 19 inwardly pressing the low relief 16, and horizontally mobile, having a trigger 18 which can be pulled by an electromechanical linear actuator 20. The lower end of the rod 10 is conic to facilitate the displacement of the latch 17 whenever this rod penetrates into the hole of the base 3 and arrives at the hollow part thereof, and at the same end there is located the bearing 15 of the screw 14. Projecting outwardly of the rod 10, the screw 14 has protruding radial teeth 21 at the end.

Figure 4:
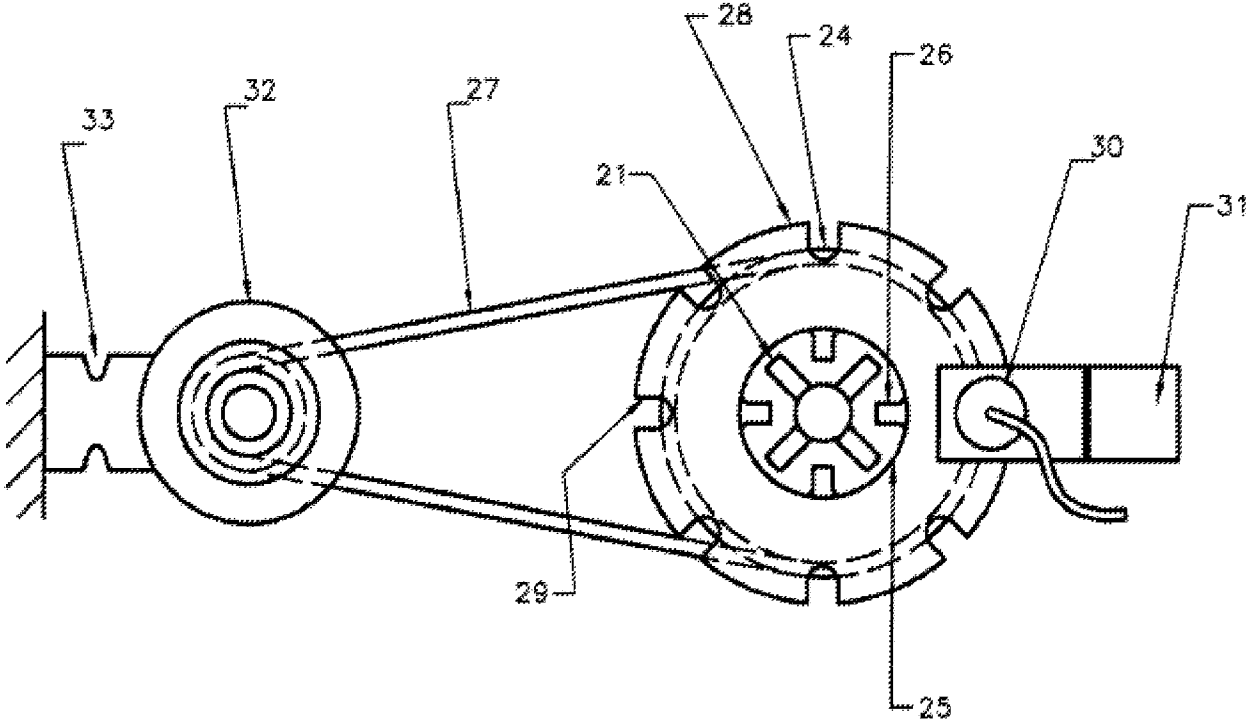
FIG. 4 is a top view of the motor combination and drive pulley, in accordance with some aspects of the present invention.

As shown in FIG. 4, in a concentric manner to the rod 10 and therefore, concentric to the screw 14, the base 3 has, on the inner face, a fixed shaft 22, with a bearing 23 that permits the turning of a pulley 24, which has a circular reentrancy 25, where there can be housed the end of the screw 14 with its teeth 21, and where it has protrusions 26 pointing inwardly, providing rotating drag movement between pulley 24 and screw 14. The pulley 24 has, on its outer circular face a channel for a belt 27 and a disk 28 with recesses 29 or holes for driving an optical or inductive sensor 30 mounted on a support 31 of the base 3.

The pulley 24 is driven, by way of the belt 27, by an electric motor 32 mounted on the inner wall of the base 3 by a cushion 33 shock absorber. A latch 17 and its trigger 18 have their position detected by an inductive or electromechanical sensor 34 fixed to or incorporated in the linear actuator 20. The information of this sensor 34 is taken to the command panel of the weight selector, situated in the fitness station.

The rod 10 has, below the level of the lower engagement pins 11 a special pin 35 which can be displaced when the nut 13 arrives at its level, the base 3 having an inductive sensor 36 situated at a level that coincides with the level of this special pin 35 when the rod is at its lowest point in the tower. The sensor 36 perceives when the special pin 35 is outjutting and relays the information to the command panel of the fitness station, which interprets the initial position of the nut 13, resetting the turn count of the screw 14 so that the other turns place it exactly facing the pins 11 at the level of the plate 4 the user wishes to engage.

The number of turns of the screw 14 made, propelled by the motor 32, belt 27, pulley 24 and the interlocking of the teeth 21 with the protrusions 26 of the pulley 24, is counted by the passage of the recesses 29 of the disk 28 facing the sensor 30, which sends electrical signals to the command panel of the fitness station.

When the rod 10, jointly with the plates 4 selected rises, tractioned by the steel cable 8, the teeth 21 of the screw 14 disengage from the protrusions 26 of the circular reentrancy 25 of the pulley 24, fixing the inoperative screw 14, whereby guaranteeing the engagement status of the rod 10 with the selected plate 4, not producing any accidental effect on the drive of the motor 32.

When the rod 10 descends to its lowest level, the latch 17 encases in the circular low relief 16 thereof, preventing it from rising again if the steel cable 8 tries to re-lift it.

The latch 17, in turn, is kept in locked position while the command panel of the fitness station carries out, by way of the motor 32, belt 27, pulley 24 engaged by the protrusions 26 to the teeth 21 of the screw 14, the change in the selection of plates 4 to be lifted, after which the command panel drives the linear actuator 20, which pulls the trigger 18, and the latch 17 abandons the low relief 16 releasing the rod 10 to rise again.

At the same time, the sensor 34 advises the command panel of the drive state of the latch 17, to authorize the drive of the motor 32 only with locking of the rod 10.

The above-described electromechanical system for selecting weights in fitness station weights towers provides following advantages:

- it places the electromechanical drive system for selecting weights on a fixed base of the tower, protected against mechanical shocks or potential free fall;
- it allows movement for selecting weights only when all the plates are in rest position, on the base of the tower;
- it prevents the rod and the weight plates from being raised when the electromechanical combination for selecting weights is in operation; and
- it does not require electric communication cables between the cursor 6, which accompanies the weight plates and the tower.

While the present invention has been described in connection with preferred aspects, it will be understood by those skilled in the art that variations and modifications of the preferred aspects described above may be made without departing from the scope of the invention. Other aspects will be apparent to those skilled in the art from a consideration of the specification or from a practice of the invention disclosed herein.

The invention claimed is:

1. An electromechanical system for selecting weights in fitness station weights towers comprising: a tower, formed by vertical columns, upper crosspiece, base, with a stack of plates of unit weights, with vertical guides inside the tower, fixed to the upper crosspiece and to the base, with a stack of plates headed by a cursor which at the center fastens to steel cable that lifts the weights, the cursor having a central rod projected downwards, penetrating into central holes of all the plates and provided with a vertical screw disposed at a hollow center of the rod and mounted thereon by bearings situated on upper and lower parts of the rod, wherein the base of the tower is hollow, having installed on its inside an electromechanical mechanism for selecting weights, including an electric motor, at least a belt, and at least a pulley, mounted by bearing on a shaft fixed to the lower face of the base, collinearly to the center of the rod and the screw, the pulley having in the upper part, a selective engagement mechanism with the lower end of the screw to actuate only when the rod is totally lowered, with the plates resting on the base of the tower.

2. The electromechanical system according to claim 1, wherein the selective engagement mechanism of the pulley is defined, in its upper part, by a circular cutout with protrusions pointing inwards, and in which there are encased radial teeth provided at the lower end of the screw, which projects downwards of a bearing, so as to enable encasement and rotating drag between pulley and screw which occurs only when the rod is totally lowered, with the plates resting on the base of the tower.

3. The electromechanical system according to claim 1, wherein the rod extends below the lower plate, traversing the upper wall of the base, where it has a circular cone-ended low relief, in which there is encased a mobile latch of an axial locking element commanded by an electromechanical linear actuator fixed to the base, also having an inductive or electromechanical sensor which detects the relative position of the latch.

4. The electromechanical system according to claim 3, wherein the rod extends below the lower plate, traversing the upper wall of the base, such that its end provided with a circular cone-edged low relief, receives the selective encasement of the mobile latch, which is provided with a spring that presses it against the low relief and provided with a trigger that can be pulled by the electromechanical linear actuator fixed to the base; and the inductive or electromechanical sensor detects the relative position of this trigger and consequently of the latch.

5. The electromechanical system according to claim 1, wherein the pulley has a disk with recesses or holes to drive an optical or inductive sensor, mounted on a support of the base, so that the command and monitoring panel of the fitness station counts the turns of the screw to select a certain plate.

6. The electromechanical system according to claim 1, wherein there is provided an inductive sensor mounted on the upper wall of the base, at the hole where the rod passes, detecting the presence of the cursor for selecting weights to restart the pulse count of the sensor that determines which plate should be engaged.

7. The electromechanical system according to claim 1, wherein the central rod is disposed between the vertical guides.

* * * * *